US005520563A

United States Patent [19]

Wallace et al.

[11] Patent Number: 5,520,563

[45] Date of Patent: May 28, 1996

[54] METHOD OF MAKING A FIELD EMISSION DEVICE ANODE PLATE HAVING AN INTEGRATED GETTER

[75] Inventors: Robert M. Wallace; Bruce E. Gnade, both of Dallas; Chi-Cheong Shen, Richardson; Jules D. Levine, Dallas; Robert H. Taylor, Richardson, all of Tex.

[73] Assignee: Texas Instruments Incorporated, Dallas, Tex.

[21] Appl. No.: 474,429

[22] Filed: Jun. 7, 1995

Related U.S. Application Data

[62] Division of Ser. No. 258,803, Jun. 10, 1994, Pat. No. 5,453,659.

[51] Int. Cl.[6] ..... H01J 9/227

[52] U.S. Cl. ..... 445/24; 445/41

[58] Field of Search ..... 445/24, 25, 41, 445/55

[56] References Cited

U.S. PATENT DOCUMENTS

| | | | |
|---|---|---|---|
| 3,755,704 | 8/1973 | Spindt et al. . | |
| 3,980,446 | 9/1976 | Porta et al. . | |
| 4,608,518 | 8/1986 | Fukuda et al. . | |
| 4,940,916 | 7/1990 | Borel et al. . | |
| 5,063,323 | 11/1991 | Longo et al. . | |
| 5,194,780 | 3/1993 | Meyer . | |
| 5,223,766 | 6/1993 | Nakayama et al. . | |
| 5,225,820 | 7/1993 | Clerc . | |
| 5,283,500 | 2/1994 | Kochanshi . | |
| 5,371,431 | 12/1994 | Jones et al. | 313/309 |

*Primary Examiner*—Kenneth J. Ramsey

*Attorney, Agent, or Firm*—Christopher L. Maginniss; W. James Brady, III; Richard L. Donaldson

[57] ABSTRACT

An anode plate 40 for use in a field emission flat panel display device comprises a transparent planar substrate 42 having a plurality of electrically conductive, parallel stripes 46 comprising the anode electrode of the device, which are covered by phosphors $\mathbf{48}_R$, $\mathbf{48}_G$ and $\mathbf{48}_B$, and a gettering material 52 in the interstices of the stripes 46. The gettering material 52 is preferably selected from among zirconium-vanadium-iron and barium. The getter 52 may be thermally reactivated by passing a current through it at selected times, or by electron bombardment from microtips on the emitter substrate. The getter 52 may be formed on a substantially opaque, electrically insulating material 50 affixed to substrate 42 in the spaces formed between conductors 46, which acts as a barrier to the passage of ambient light into and out of the device. Methods of fabricating the getter stripes 52 on the anode plate 40 are disclosed.

21 Claims, 8 Drawing Sheets

METHOD OF MAKING A FIELD EMISSION DEVICE ANODE PLATE HAVING AN INTEGRATED GETTER

This is a division of application Ser. No. 08/258,803, filed Jun. 10, 1994, now U.S. Pat. No. 5,453,659.

RELATED APPLICATIONS

U.S. patent application Ser. No. 08/247,951, "Opaque Insulator for Use on Anode Plate of Flat Panel Display," filed 24 May 1994.

U.S. patent application Ser. No. 08/253,476, "Flat Panel Display Anode Plate Having Isolation Grooves," filed 3 Jun. 1994.

TECHNICAL FIELD OF THE INVENTION

The present invention relates generally to field emission flat panel display devices and, more particularly, to a structure and method for providing improved gettering within such a device by use of an integrated, thin-film getter material on the anode plate which can be selectively activated.

BACKGROUND OF THE INVENTION

The advent of portable computers has created intense demand for display devices which are lightweight, compact and power efficient. Since the space available for the display function of these devices precludes the use of a conventional cathode ray tube (CRT), there has been significant interest in efforts to provide satisfactory flat panel displays having comparable or even superior display characteristics, e.g., brightness, resolution, versatility in display, power consumption, etc. These efforts, while producing flat panel displays that are useful for some applications, have not produced a display that can compare to a conventional CRT.

Currently, liquid crystal displays are used almost universally for laptop and notebook computers. In comparison to a CRT, these displays provide poor contrast, only a limited range of viewing angles is possible, and, in color versions, they consume power at rates which are incompatible with extended battery operation. In addition, color screens tend to be far more costly than CRT's of equal screen size.

As a result of the drawbacks of liquid crystal display technology, field emission display technology has been receiving increasing attention by industry. Flat panel displays utilizing such technology employs a matrix-addressable array of pointed, thinfilm, cold field emission cathodes in combination with an anode comprising a phosphor-luminescent screen. The phenomenon of field emission was discovered in the 1950's, and extensive research by many individuals, such as Charles A. Spindt of SRI International, has improved the technology to the extent that its prospects for use in the manufacture of inexpensive, low-power, high-resolution, high-contrast, full-color flat displays appear to be promising.

Advances in field emission display technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frederic Clerc. These patents are incorporated by reference into the present application.

In flat panel displays of the field emission type, the electron emitting surface of the emitter plate and the opposed display face of the anode plate are spaced from one another at a relatively small distance over the extent of the display. This spacing, typically on the order of 200 μmeters (microns), limits the total volume of the cavity enclosed within an illustrative 10-inch diagonal display screen to less than 10 $cm^3$.

In order for field emission displays to operate efficiently, it is necessary to maintain a good vacuum within the cavity of the display, typically on the order of $10^{-7}$ torr. The cavity is pumped out and degassed before assembly, but over time the pressure in the display builds up due to outgassing of the components inside the display and to the finite leak rate of the atmosphere into the cavity. As the pressure increases, the efficiency of the field emissions from the tip, and the phosphor luminescence decreases. Clearly, even the slightest leak rate or outgassing rate severely impacts a vacuum pressure level of $10^{-7}$ torr within the above-described minute cavity of the fiat panel display.

In evacuated display devices, getters are employed for adsorbing gases which are generated by components and gases which leak in from the atmosphere, so as to maintain a minimum pressure in the vacuum panel assembly. Since it is not currently known how to provide such a getter in any portion corresponding to the effective screen area, the getter is placed mostly in peripheral regions of the display device, frequently in the inactive regions between the front panel and the cathode outside of the screen area. As an example, in the apparatus disclosed in U.S. Pat. No. 5,063,323, "Field Emitter Structure Providing Passageways for Venting of Outgassed Materials from Active Electronic Area," issued 5 Nov. 1991, to R. T. Longo et al., outgassed materials liberated in spaces between pointed field emitter tips and an electrode structure are vented through passageways to a pump or gettering material provided in a separate space.

However, if the getter is positioned outside the effective screen area, this inactive external area must be dimensionally increased, which, as a consequence, substantially reduces the effective screen. There is also the disadvantage of diminution of the gas adsorption effect at the center of the screen, contributing to deterioration of the image quality. In one application known to the applicants, a field emission flat panel display includes a seal-off/pump-out tube on the back of the display, where a small piece of getter material, approximately two square inches, is placed. However, since new advances in field emission fiat panel display technology have made the seal-off tube unnecessary, this volume is no longer available for the placement of getter material. Since the FED has so little extra space inside the display cavity, there is no room for large pieces of conventional getter material. Without getter material to help maintain the vacuum, the useful lifetime of the display is shortened.

U.S. Pat. No. 5,223,766, "Image Display Device with Cathode Panel and Gas Absorbing Getters," issued 29 Jun. 1993, to A. Nakayama, discloses an image display having getter material in a space between a cathode panel and a back panel, and having holes in the cathode panel for adsorption of residual gases. In another embodiment of this patent, the cathode panel is supported from the back panel by a plurality of getters. In still another embodiment of the Nakayama patent, the gate electrodes are composed of a getter material.

U.S. Pat. No. 5,283,500, "Flat Panel Field Emission Display Apparatus," issued 1 Feb. 1994, to G. P. Kochanski, discloses active gettering devices comprising micropoints fabricated from one of the known getter metals. Evaporation of getter material occurs as a result of a potential which is selectively applied between the getter micropoint and the associated gate electrode. This approach, in which the evaporated getter metal is deposited on the anode, is deemed deleterious to the phosphor coating, and it is expected that the deposited getter will eventually result in significant deterioration of the display luminosity. It would also appear that the number of getter metal micropoints proposed by the patentee may not be adequate to provide proper gettering for the display.

In view of the above, it is clear that there exists a need for a flat panel display device having a substantial area of getter material, wherein the getter material is in close proximity to the display elements which are subject to outgassing, and in close proximity to those elements of the display which are adversely affected by increases in gas pressure. In addition, there exists a need for a getter material which is placed such it can be periodically reactivated within its operational configuration.

SUMMARY OF THE INVENTION

In accordance with the principles of the present invention, there is disclosed herein an anode plate for use in a field emission device. The anode plate comprises a substantially transparent substrate having spaced-apart, electrically conductive regions on the substrate and luminescent material overlaying the conductors. The anode plate further comprises gettering material between the conductive regions and electrically isolated therefrom.

In accordance with a preferred embodiment of the present invention, the spaced-apart, electrically conductive regions comprise stripes, and the gettering material, which may be selected from the group comprising zirconium-vanadium-iron and barium, is affixed to an opaque insulating material on the substrate in the interstices of the electrically conductive stripes.

Further in accordance with the principles of the present invention, there is disclosed herein an electron emission display apparatus. The display apparatus comprises an emitter structure including means for emitting electrons, and a display panel having a substantially planar face opposing the emitter structure. The display panel comprises a substantially transparent substrate, spaced-apart, electrically conductive stripes on the substrate, luminescent material overlaying the conductive stripes, and gettering material in the interstices of the conductive stripes.

The preferred display apparatus further includes means for activating the gettering material by coupling thermal energy thereto. The activating means may comprise means for coupling electrical current through the gettering material. Alternatively, it may comprise means for accelerating electrons emitted by the emitting means onto the gettering material.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
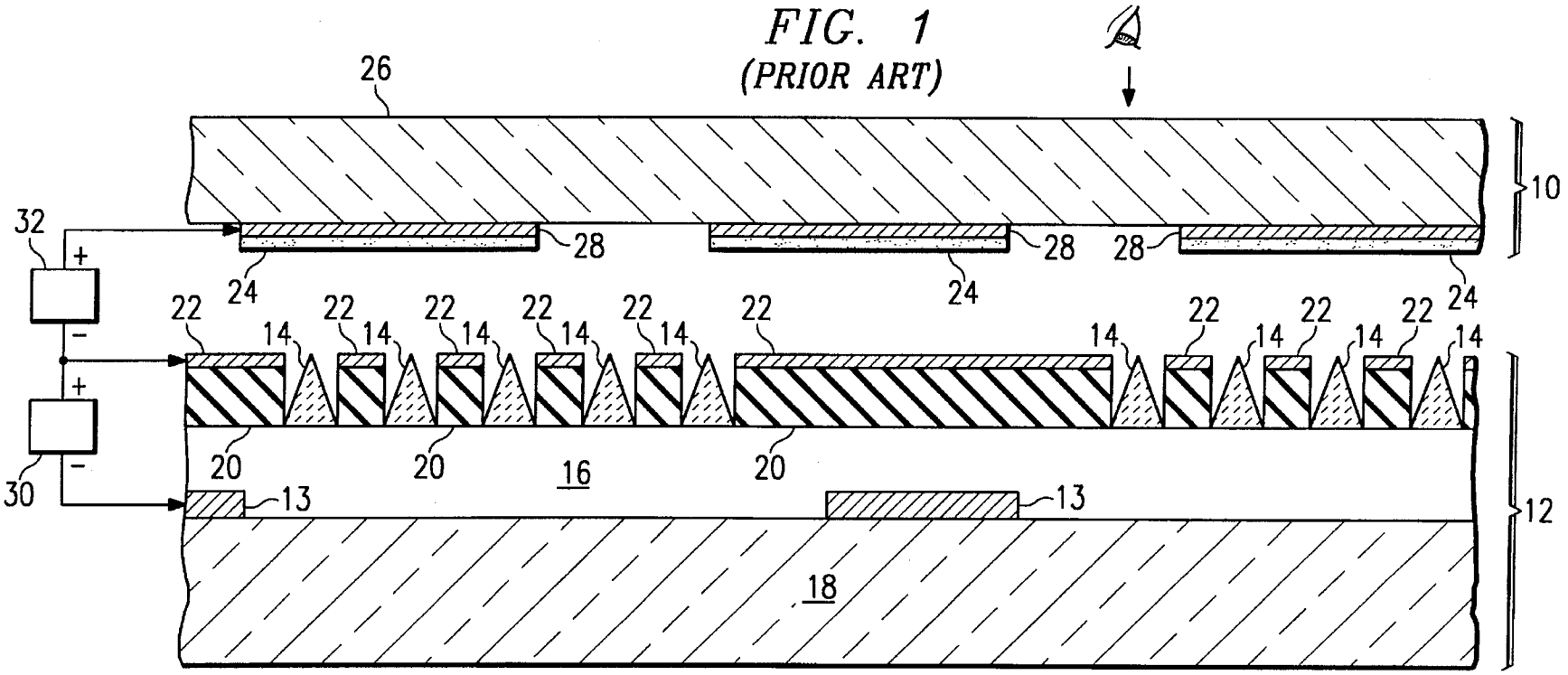
FIG. 1 (PRIOR ART)
FIG. 1 illustrates in cross section a portion of a field emission flat panel display device according to the prior art.

Referring initially to FIG. 1, there is shown in cross-sectional view, a portion of an illustrative, prior an field emission flat panel display device. In this embodiment, the field emission device comprises an anode plate having an electroluminescent phosphor coating facing an emitter plate, the phosphor coating being observed from the side opposite to its excitation.

More specifically, the illustrative field emission device of FIG. 1 comprises a cathodoluminescent anode plate 10 and an electron emitter (or cathode) plate 12. The cathode portion of emitter plate 12 includes conductors 13 formed on an insulating substrate 18, a resistive layer 16 also formed on substrate 18 and overlaying conductors 13, and a multiplicity of electrically conductive microtips 14 formed on resistive layer 16. In this example, conductors 13 comprise a mesh structure, and microtip emitters 14 are configured as a matrix within the mesh spacings.

A gate electrode comprises a layer of an electrically conductive material 22 which is deposited on an insulating layer 20 which overlays resistive layer 16. Microtip emitters 14 are in the shape of cones which are formed within apertures through conductive layer 22 and insulating layer 20. The thicknesses of gate electrode layer 22 and insulating layer 20 are chosen in conjunction with the size of the apertures therethrough so that the apex of each microtip 14 is substantially level with the electrically conductive gate electrode layer 22. Conductive layer 22 is arranged as rows of conductive bands across the surface of substrate 18, and the mesh structure of conductors 13 is arranged as columns of conductive bands across the surface of substrate 18, thereby permitting selection of microtips 14 at the intersection of a row and column corresponding to a pixel.

Anode plate 10 comprises regions of a transparent, electrically conductive material 28 deposited on a transparent planar support 26, which is positioned facing gate electrode 22 and parallel thereto, the conductive material 28 being deposited on the surface of support 26, or on an optional thin insulating layer of silicon dioxide ($SiO_2$) (not shown), directly facing gate electrode 22. In this example, the regions of conductive material 28, which comprise the anode electrode, are in the form of electrically isolated stripes comprising three series of parallel conductive bands across the surface of support 26, as taught in the Clerc ('820) patent. (No true scaling information is intended to be conveyed by the relative sizes and positioning of the elements of anode plate 10 and the elements of emitter plate 12 as depicted in FIG. 1.) Anode plate 10 also comprises a cathodoluminescent phosphor coating 24, deposited over conductive regions 28 so as to be directly facing and immediately adjacent gate electrode 22.

One or more microtip emitters 14 of the above-described structure are energized by applying a negative potential to conductors 13, functioning as the cathode electrode, relative to the gate electrode 22, via voltage supply 30, thereby inducing an electric field which draws electrons from the apexes of microtips 14. The freed electrons are accelerated toward the anode plate 10 which is positively biased by the application of a substantially larger positive voltage from voltage supply 32 coupled between the gate electrode 22 and conductive regions 28 functioning as the anode electrode. Energy from the electrons attracted to the anode conductors 28 is transferred to the phosphor coating 24, resulting in luminescence. The electron charge is transferred from phosphor coating 24 to conductive regions 28, completing the electrical circuit to voltage supply 32.

Figure 2A:
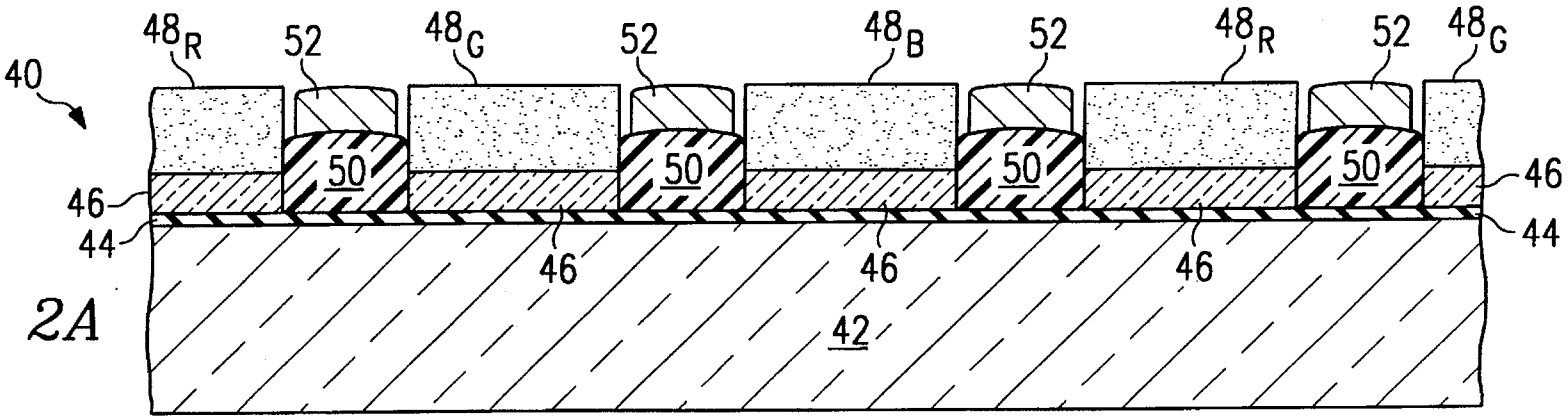
FIG. 2A is a cross-sectional view of an anode plate having getter stripes in accordance with a first embodiment of the present invention.

Referring now to FIG. 2A, there is shown a cross-sectional view of an anode plate 40 for use in a field emission flat panel display device in accordance with a first embodiment of the present invention. Anode plate 40 comprises a transparent planar substrate 42 having a thin layer 44 of an insulating material, illustratively silicon dioxide ($SiO_2$). A plurality of electrically conductive regions 46 are patterned on insulating layer 44. Conductive regions 46 collectively comprise the anode electrode of the field emission flat panel display device of the present invention. Luminescent material $\mathbf{48}_R$, $\mathbf{48}_G$ and $\mathbf{48}_B$, referred to collectively as luminescent material 48, overlays conductors 46. An electrically insulating material 50 is affixed to substrate 42 in the spaces between conductors 46. By virtue of its electrical insulating quality, material 50 serves to increase the electrical isolation of conductive regions 46 from one another, thereby permitting the use of higher anode potentials without the risk of breakdown due to increased leakage current. A layer 52 of a getter material overlays insulating material 50. A gap is left between the getter material 52 and the luminescent material 48 to maintain electrical isolation.

In the present example, substrate 42 preferably comprises glass. For the case where ultraviolet emission is important, substrate 42 may comprise quartz. Also in this example, conductive regions 46 comprise a plurality of parallel stripe conductors which extend normal to the plane of the drawing sheet. A suitable material for use as stripe conductors 46 may be indium-tin-oxide (ITO), which is optically transparent and electrically conductive. By way of illustration, stripe conductors 46 may be 80 microns in width, and spaced from one another by 30 microns. In this example, luminescent material 48 comprises a particulate phosphor coating which luminesces in one of the three primary colors, red ($\mathbf{48}_R$), green ($\mathbf{48}_G$) and blue ($\mathbf{48}_B$). The thickness of conductors 46 may be approximately 150 nanometers, and the thickness of phosphor coatings 48 may be approximately 15 microns. A preferred process for applying phosphor coatings 48 to stripe conductors 46 comprises electrophoretic deposition.

Insulating material 50 is preferably formed from a solution of tetraethoxysilane, referred to by its acronym, "TEOS," which is sold by, for example, Allied Signal Corp., of Morristown, N.J. The solution of TEOS, including a solvent which may comprise ethyl alcohol, acetone, N-butyl alcohol and water, is commonly referred to as "spin-on-glass" (SOG). The TEOS and solvents are combined in proportions according the desired viscosity of the spin-on-glass solution. TEOS provides the advantages that it cures at a relatively low temperature and, when fully cured, most of the solvent and most of the organic materials have been driven out, leaving primarily glass ($SiO_x$). The TEOS solution may be spun on the surface of anode plate 40, or it may be spread on the surface, using techniques which are well known in the manufacture of, for example, liquid crystal display devices. By way of illustration, electrically insulating material 50 may have an average thickness on the order of 500–1000 nanometers.

In accordance with the present invention, getter material 52 illustratively comprises zirconium-vanadium-iron (ZrVFe) or barium (Ba); one source of ZrVFe is SAES Getters of Milan, Italy. Getter material 52 is preferably deposited as a thin-film, using ion-beam sputtering, e-beam evaporation, or any other appropriate deposition technique. The thickness of getter material 52 may range between 100 and 1000 nanometers. Once the getter is deposited, it will require an initial activation process of elevating the temperature of the integrated getter to approximately 300° C. while the display is being assembled under high vacuum conditions.

Figure 2B:
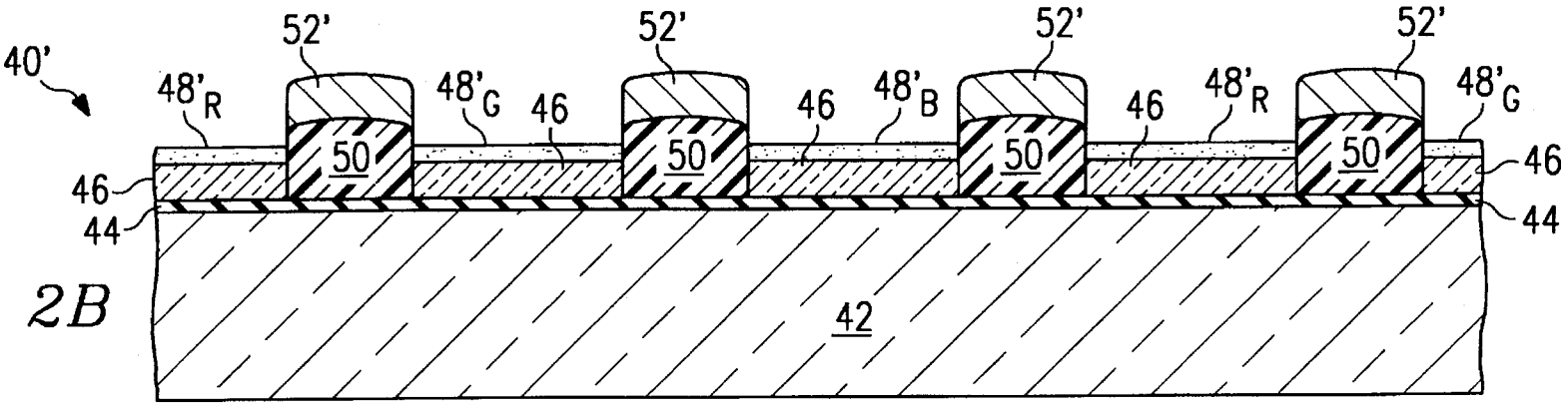
FIG. 2B is a cross-sectional view of an anode plate having getter stripes in accordance with a second embodiment of the present invention.

Referring now to FIG. 2B, there is shown a cross-sectional view of an anode plate 40' for use in a field emission flat panel display device in accordance with a second embodiment of the present invention. In the discussion relating to FIG. 2B, elements which are identical to those already described in relation to FIG. 2A are given identical numerical designators, and those elements which are similar in structure and which perform identical functions to those already described in relation to FIG. 2A, are given the primed numerical designators of their counterparts. In this embodiment, anode plate 40' includes layers of luminescent material $\mathbf{48}_R'$, $\mathbf{48}_G'$, and $\mathbf{48}_B'$, referred to collectively as luminescent material 48', overlaying conductors 46. Luminescent material 48' comprises thin-film phosphors which may be deposited to a thickness of approximately 20–30 nanometers. Thin-film phosphors have been demonstrated, and may include, for example, tungsten-doped zinc oxide.

With this configuration, the total thickness of conductors 46 and thin-film phosphor material 48' may be in the order of 400–500 nanometers, which is significantly less than the thickness of insulating material 50, which may typically be in the order of 1000 nanometers. As such, the top surface of thin-film phosphor material 48' is below the top surface of insulating material 50, and integrated getter material 52' may cover the entire upper surface of insulating material 50 without concern about electrical contact with thin-film phosphor material 48'.

The surface area available for getter material on the anode plates of the present invention is significantly greater than on many structures of the prior art. In the embodiment of FIG. 2B, where the entire interstitial width between conductors 46 of 30 microns is available for gettering material, the getter area for a 10-inch-diagonal color display, having 640 lines of each of three colors approximately six inches in length is almost 14 $in^2$ (about 90 $cm^2$), compared with about 2 $in^2$ of getter surface in a prior art display device known to the applicants. In the embodiment of FIG. 2A, where less than the entire interstitial width is available for gettering material, the available getter area for this device is still expected to exceed 10 $in^2$ (about 65 $cm^2$).

Figure 3:
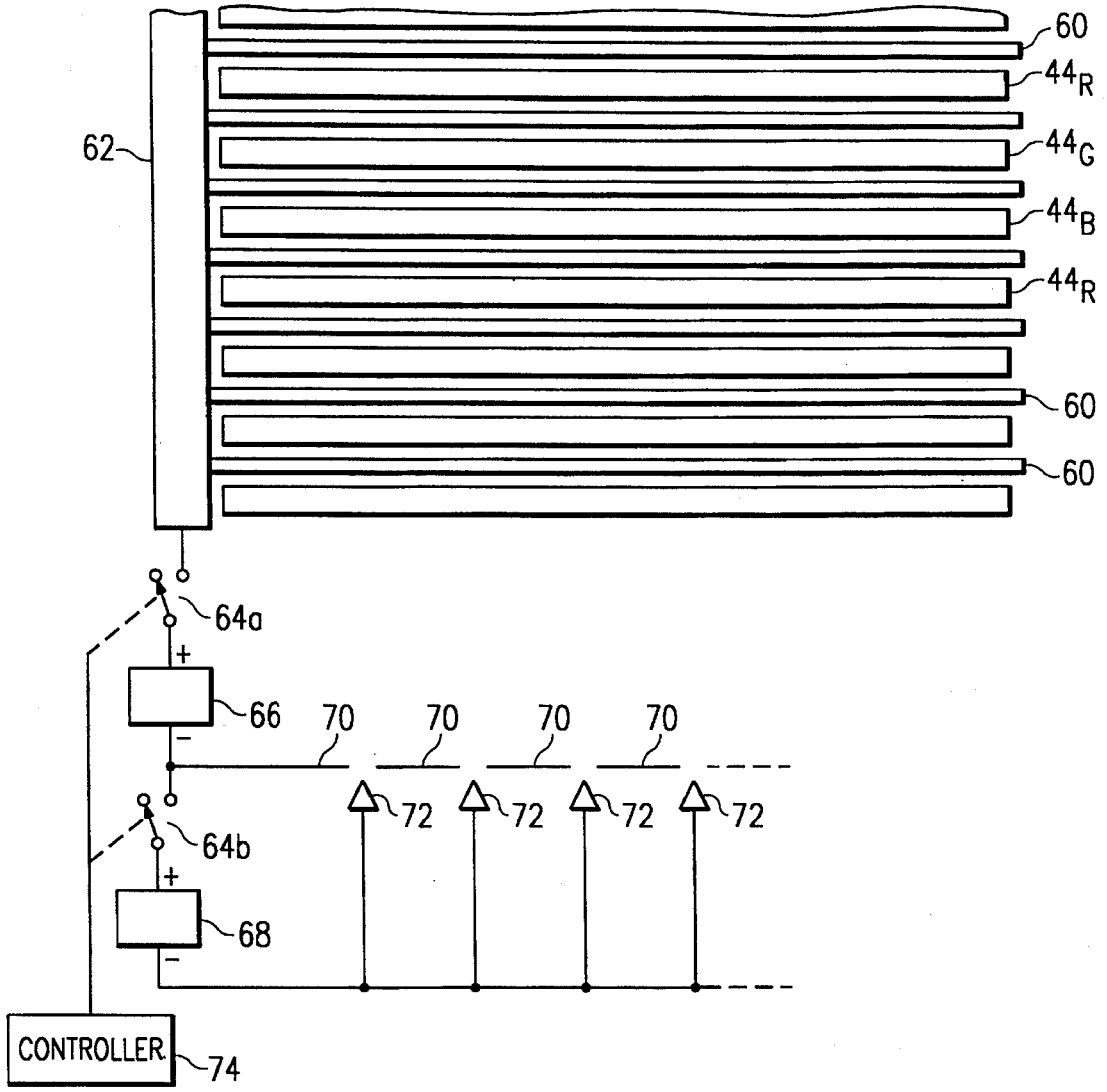
FIG. 3 illustrates circuitry for use in activating the getter stripes of FIGS. 2A and 2B according to a first embodiment.

Referring now to FIG. 3, there is illustrated circuitry for use in reactivating the integrated getter stripes of FIGS. 2A and 2B according to a first embodiment. In this case, the getter comprises a plurality of stripes 60 of getter material which are joined at one end thereof to an electrically conductive bus 62. The getter stripes 60 are interspersed in the spacings between phosphorescent stripes $44_R$, $44_G$ and $44_B$. Bus 62 is coupled through switching device 64*a* to the positive (+) terminal of power supply 66. The negative (–) terminal of voltage supply 66 is coupled to gate electrode 70 (similar to gate electrode 22 of FIG. 1). Voltage supply 68 couples a positive potential through switching device 64*b* to gate electrode 70; the negative terminal of supply 68 is coupled to microtip emitters 72 (similar to emitters 14 of FIG. 1). Process controller 74 determines the state of switching devices 64*a* and 64*b*, which, although shown functionally as poles of a switch, are more likely to be implemented as semiconductor switching devices. The potential provided by supply 68 is sufficient to cause electron emission from micropoints 72, and the potential provided by supply 66 is sufficient to accelerate the freed electrons toward getter stripes 60.

Using this arrangement, controller 74 actuates switching device 64 so as to couple the positive potential from supply 66 at a predetermined time interval, or in response to a specific event. For instance, switching device 64 may be activated for a period of approximately 30–60 seconds each time the display device is powered up. During this period, the electric field induced by voltage supply 68 causes emission of electrons from micropoints 72, which electrons are accelerated toward getter stripes 60 by the potential from supply 66. The bombardment of the electrons on the getter material of stripes 60 results in the heating of the getter material, increasing the diffusion rate of the getter surface oxide into the interior of the material and leaving fresh getter material at the surface, thus reactivating the getter and increasing pumping speed. The manner in which micropoints 72 are energized for this reactivation process may comprise a scanning sequence similar to the row-and-column addressing used by the device for displaying video information under normal operation.

Figure 4:
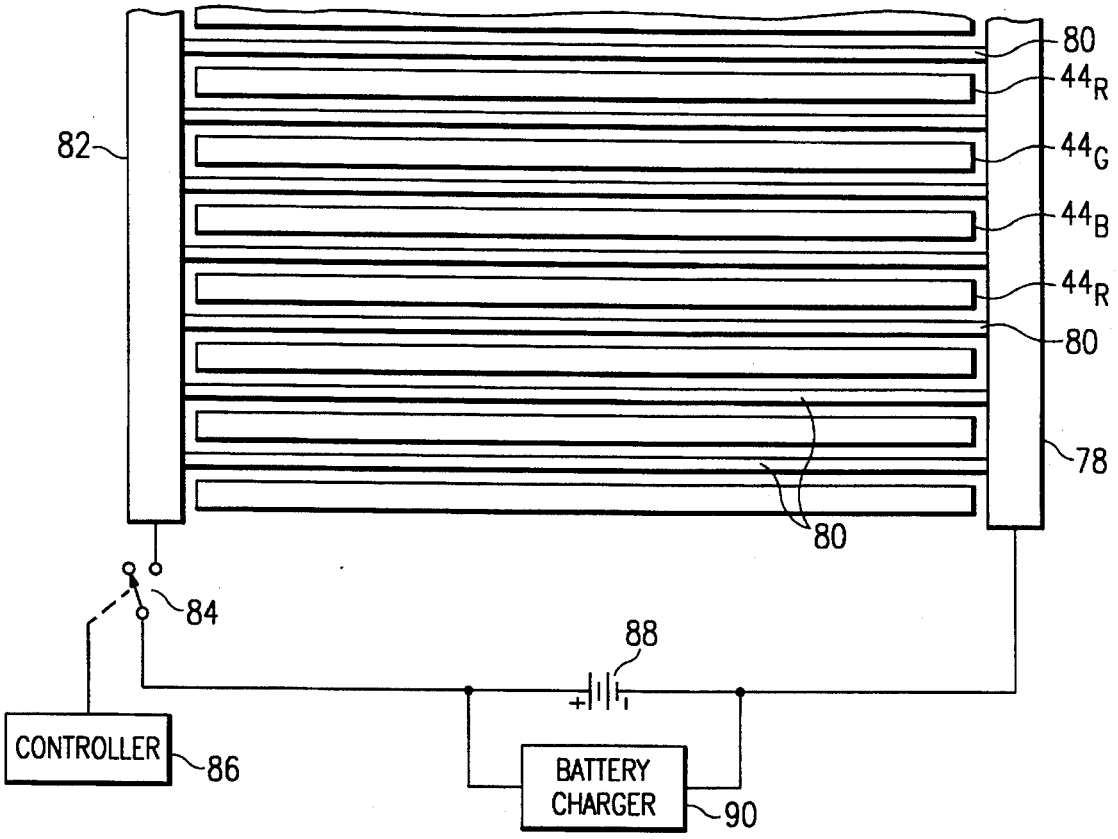
FIG. 4 illustrates circuitry for use in activating the getter stripes of FIGS. 2A and 2B according to a second embodiment.

Referring now to FIG. 4, there is illustrated circuitry for use in reactivating the integrated getter stripes of FIG. 2 according to a second embodiment. In this case, the getter comprises a plurality of stripes 80 of getter material which are joined at both ends to electrically conductive buses 78 and 82, respectively. The getter stripes 80 are interspersed in the spacings between phosphorescent stripes $44_R$, $44_G$ and $44_B$. Bus 82 is coupled through switching device 84 to one terminal of voltage supply 88, which may illustratively comprise a battery used in the operation of the flat panel display device. The other terminal of supply 88 is coupled to bus 78.

Using this arrangement, controller 86 actuates switching device 84 so as to enable current flow from supply 88 through getter stripes 80 via buses 82 and 78 at a predetermined time interval, or in response to a specific event. Since the getter materials considered herein, namely ZrVFe and barium, are resistive, stripes 80 will be heated in response to this current flow. This heating of the getter material increases the diffusion rate of the getter oxide into the interior of the material, leaving fresh getter material at the surface, thus reactivating the getter. Since resistance heating of getter stripes 80 requires a significant amount of current, it may be desirable to program controller 86 to activate switching device 84 only when the display battery 88 is connected to a charging system 90. In order to avoid overheating the getter material, controller 86 may be configured to enable charging current to getter stripes 80 for, typically, thirty seconds at the onset of each charging period of display battery 88.

Figure 5A:
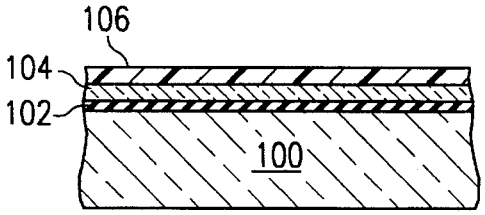
FIGS. 5A through 5J illustrate steps in a first process for fabricating the anode plate of FIG. 2A.

A method of fabricating anode plate 40 (of FIG. 2A) for use in a field emission flat panel display device in accordance with a first embodiment incorporating the principles of the present invention, comprises the following steps, considered in relation to FIGS. 5A through 5J. Referring initially to FIG. 5A, a glass substrate 100 is coated with an insulating layer 102, typically $SiO_2$, which may be sputter deposited to a thickness of approximately 50 nm. A layer 104 of a transparent, electrically conductive material, typically indium-tin-oxide (ITO), is deposited on layer 102, illustratively by sputtering to a thickness of approximately 150 nm. A layer 106 of photoresist, illustratively type AZ-1350J sold by Hoescht-Celanese, of Somerville, N.J., is coated over layer 104, to a thickness of approximately 1000 nm.

Figure 5B:
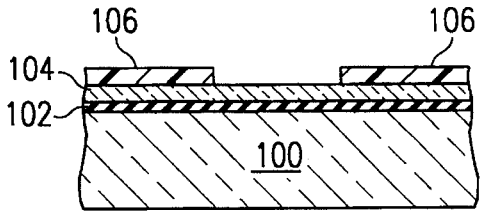
Figure 5C:
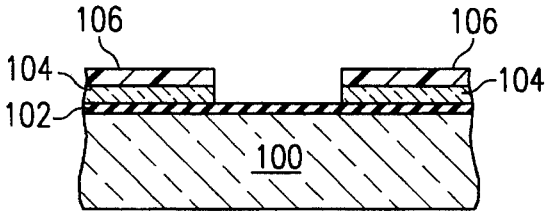
Figure 5D:
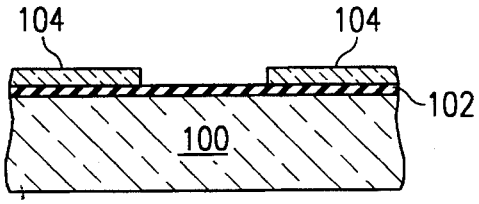

A patterned mask (not shown) is disposed over layer 106 exposing regions of the photoresist. In the case of this illustrative positive photoresist, the exposed regions are removed during the developing step, which may comprise soaking the assembly in Hoescht-Celanese AZ-developer. The developer removes the unwanted photoresist, leaving photoresist layer 106 patterned as shown in FIG. 5B. The exposed regions of ITO layer 104 are then removed, typically by a wet etch process, using as an illustrative etchant a solution of 6M hydrochloric acid (HCl) and 0.3M ferric chloride ($FeCl_3$), leaving a structure as shown in FIG. 5C. Although not shown as part of this process, it may also be desired to remove $SiO_2$ layer 102 underlying the etched-away regions of the ITO layer 104. In the present example, these patterning, developing and etching processes leave regions of ITO layer 104 which form substantially parallel stripes across the surface of the anode plate. The remaining photoresist layer 106 may be removed by a wet etch process using acetone as the etchant; alternatively, layer 106 may be removed using a dry, oxygen plasma ash process. FIG. 5D illustrates the anode structure having patterned ITO regions 104 at the current stage of the fabrication process.

Figure 5E:
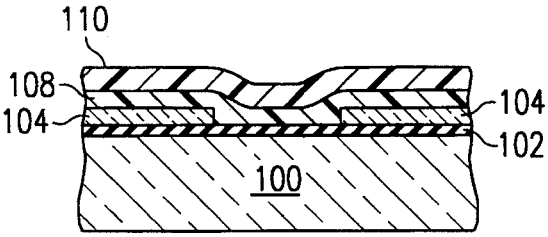

A coating 108 of spin-on-glass (SOG), which may be of a type described earlier, is applied over the striped regions of layer 104 and the exposed portion of layer 102, typically to an average thickness of approximately 1000 nm above the surface of insulating layer 102. The method of application may comprise dispensing the SOG mixture onto the assembly while substrate 100 is being spun, thereby dispersing SOG coating 108 relatively uniformly over the surface and tending to accelerate the drying of the SOG solvent. Alternatively, the SOG mixture may be uniformly spread over the surface. The SOG is then precured at 100° C. for about fifteen minutes, and then fully cured by heating it until virtually all of the solvent and organics have been driven off, typically at a temperature of 300° C. for approximately four hours. A second coating 110 of photoresist, which may be of the same type used as layer 106, is deposited over SOG layer 108, typically to a thickness of 1000 nm, as illustrated in FIG. 5E.

Figure 5F:
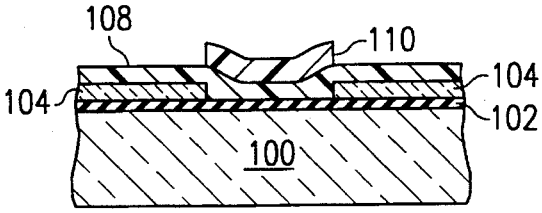
Figure 5G:
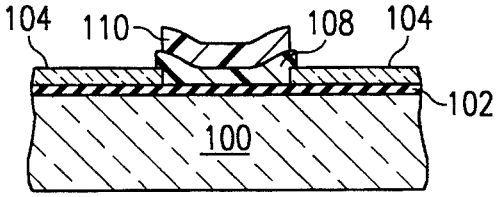

A second patterned mask (not shown) is disposed over layer 110 exposing regions of the photoresist which are to be removed during the developing step, specifically these regions lying directly over the stripes of layer 104. The photoresist is developed leaving photoresist layer 110 patterned as shown in FIG. 5F. The exposed regions of SOG layer 108 are then removed, typically by a wet etch process, using hydrofluoric acid (HF) buffered with ammonium fluoride ($NH_4F$) as an illustrative etchant, leaving a structure as shown in FIG. 5G. Alternatively, the exposed regions of SOG layer 108 may be removed using an oxide (plasma) etch process. The remaining photoresist layer 110 may be removed by a wet etch process using acetone as the etchant; alternatively, layer 110 may be removed using a dry, oxygen plasma etch process.

Figure 5H:
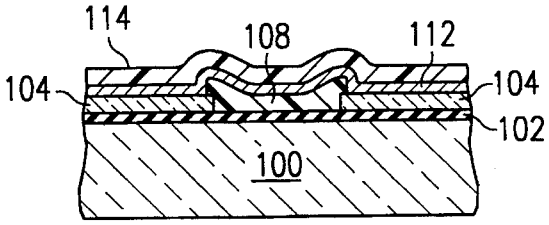

At this point, a thin-film layer 112 of a getter metal of a type discussed earlier is deposited directly on the stripes of layer 104 and the regions of cured SOG coating 108, typically to a thickness of approximately 50–100 nanometers. Getter layer 112 may be deposited, for example, by ion-beam sputtering or by e-beam evaporation. A third coating 114 of photoresist, which may be of the same type used as layers 106 and 110, is deposited over getter layer 112, typically to a thickness of 1000 nm, as illustrated in FIG. 5H.

Figure 5I:
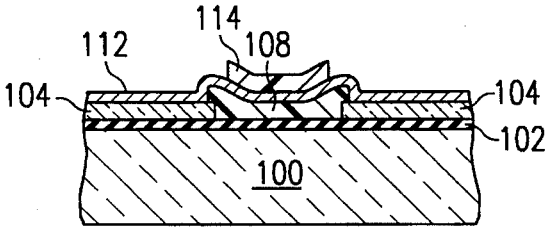

A patterned mask (not shown) is disposed over layer 114 exposing regions of this positive photoresist which are to be removed during the developing step. This developing step leaves photoresist layer 114 patterned as shown in FIG. 5I. The exposed regions of getter layer 112 are then removed, typically by a wet etch process. Here, these patterning, developing and etching processes leave regions of getter layer 112 which cover less than the full width of the spacing between ITO stripes 104. The remaining photoresist layer 114 may be removed by a wet etch process using acetone as the etchant; alternatively, layer 114 may be removed using a dry, oxygen plasma ash off process, although this process is less desirable because the oxygen plasma will oxidize the surface of the getter.

Figure 5J:
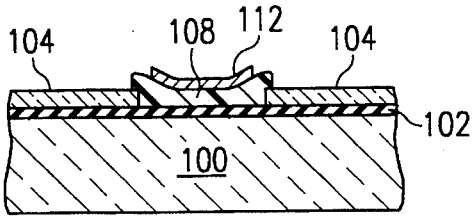

FIG. 5J illustrates the anode structure having a layer 112 of getter metal affixed to the glass insulating regions 108 which separate the patterned ITO stripes 104 at this stage of the fabrication process. The next steps in the fabrication process of the anode structure is to provide the three particulate phosphor coatings $44_R$, $44_G$ and $44_B$ (of FIG. 2A), which are deposited over conductive ITO regions 104, typically by electrophoretic deposition. It will be seen from FIG. 5J that the above-described process provides a getter layer 112 which covers less than the full width of the spacing between ITO stripes 104, and therefore ensures that a gap will exist between getter layer 112 and the particulate phosphor coating which is to be deposited on ITO stripes 104.

Figure 6A:
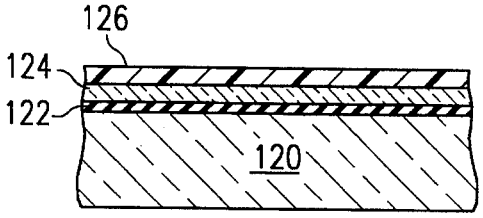
FIGS. 6A through 6G illustrate steps in a second process for fabricating the anode plate of FIG. 2A.

A method of fabricating anode plate 40 (of FIG. 2A) for use in a field emission fiat panel display device in accordance with a second embodiment incorporating the principles of the present invention, comprises the following steps, considered in relation to FIGS. 6A through 6G. Referring initially to FIG. 6A, a glass substrate 120 is coated with an insulating layer 122, typically $SiO_2$, which may be sputter deposited to a thickness of approximately 50 nm. A layer 124 of a transparent, electrically conductive material, typically indium-tin-oxide (ITO), is deposited on layer 122, illustratively by sputtering to a thickness of approximately 150 nm. A layer 126 of photoresist, which may be type SC-100 negative photoresist sold by OGC Microelectronic Materials, Inc., of West Patterson, N.J., is coated over layer 124, to a thickness of approximately 1000 nm.

Figure 6B:
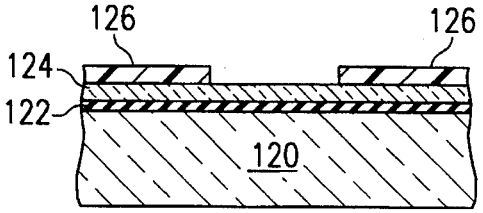
Figure 6C:
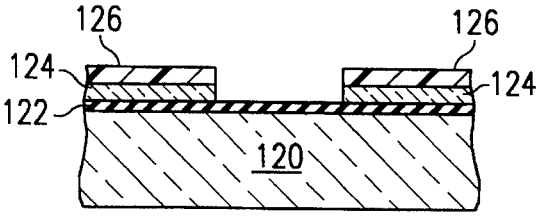
Figure 6D:
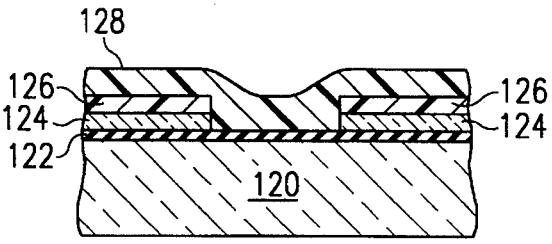

A patterned mask (not shown) is disposed over layer 126 exposing regions of the photoresist which, in the case of this illustrative negative photoresist, are to remain after the developing step, which may comprise spraying the assembly first with Stoddard etch and then with butyl acetate. The unexposed regions of the photoresist are removed during the developing step, leaving photoresist layer 126 patterned as shown in FIG. 6B. The exposed regions of ITO layer 124 are then removed, typically by a wet etch process, using as an illustrative etchant a solution of 6M hydrochloric acid (HCl) and 0.3M ferric chloride ($FeCl_3$), leaving a structure as shown in FIG. 6C. In the present example, these patterning, developing and etching processes leave regions of ITO layer 124 which form substantially parallel stripes across the surface of the anode plate. In this second embodiment, the remaining photoresist layer 126 is retained, and a coating 128 of spin-on-glass (SOG), which may be of a type described earlier, is applied over the photoresist layer 124 and the exposed portion of layer 122, typically to an average thickness of approximately 1000 nm above the surface of insulating layer 122. The method of application may comprise dispensing the SOG mixture onto the assembly while substrate 120 is being spun, thereby dispersing SOG coating 128 relatively uniformly over the surface and tending to accelerate the drying of the SOG solvent. Alternatively, the SOG mixture may be uniformly spread over the surface. FIG. 6D illustrates the anode structure having patterned ITO regions 124 and photoresist regions 126, and the coating of SOG 128 at the current stage of the fabrication process. The assembly is then heated to 100° C. br about fifteen minutes to remove most of the solvent.

Photoresist layer 126 is then removed, bringing with it the overlaying portions of SOG layer 128. This liftoff process is a common semiconductor fabrication process. The negative photoresist 126 is removed by dipping in hot xylene and a solvent comprising perchloroethylene, tetrachloroethylene, ortho-dichlorobenzene, phenol and alkylaryl sulfonic acid, in sequence. The SOG is then fully cured by heating it until virtually all of the solvent and organics have been driven off, typically at a temperature of 300° C. for approximately four hours.

Figure 6E:
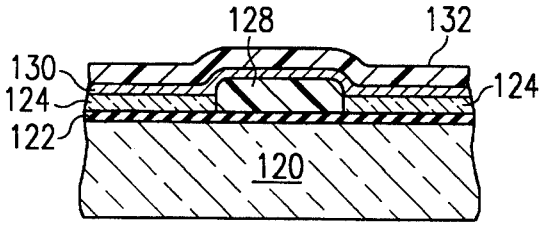

At this point, a thin-film layer 130 of a getter metal of a type discussed earlier is deposited directly on the stripes of layer 124 and the regions of cured SOG coating 128, typically to a thickness of approximately 50–100 nanometers. Getter layer 130 may be deposited, for example, by ion-beam sputtering or by e-beam evaporation. A second coating 132 of photoresist, which may be type AZ-1350J, is deposited over getter layer 130, typically to a thickness of 1000 nm, as illustrated in FIG. 6E.

Figure 6F:
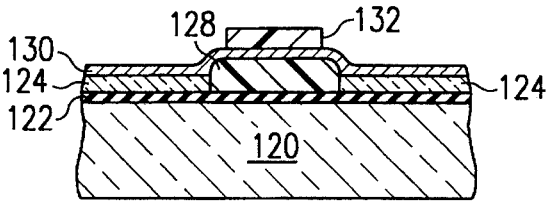

A patterned mask (not shown) is disposed over layer 132 exposing regions of this positive photoresist which are to be removed during the developing step. This developing step leaves photoresist layer 132 patterned as shown in FIG. 6F. The exposed regions of getter layer 130 are then removed, typically by a wet etch process. Here, these patterning, developing and etching processes leave regions of getter layer 130 which cover less than the full width of the spacing between ITO stripes 124. The remaining photoresist layer 132 may be removed by a wet etch process using acetone as the etchant; alternatively, layer 132 may be removed using a dry, oxygen plasma ash off process, although this process is less desirable because the oxygen plasma will oxidize the surface of the getter.

Figure 6G:
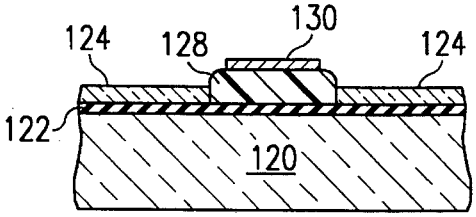

FIG. 6G illustrates the anode structure having a layer 130 of getter metal affixed to the glass insulating regions 128 which separate the patterned ITO stripes 124 at this stage of the fabrication process. The next steps in the fabrication process of the anode structure is to provide the three particulate phosphor coatings $44_R$, $44_G$ and $44_B$ (of FIG. 2A), which are deposited over conductive ITO regions 124, typically by electrophoretic deposition. It will be seen from FIG. 6G that the above-described process provides a getter layer 130 which covers less than the full width of the spacing between ITO stripes 124, and therefore ensures that a gap will exist between getter layer 130 and the particulate phosphor coating which is to be deposited on ITO stripes 124. It will be seen that the process illustrated in FIGS. 6A through 6G requires one less mask step that the process illustrated in FIGS. 5A through 5J, since the instant process requires only a single mask step to etch ITO stripes 124 and to form SOG insulator 128 in the spacings between stripes 124.

Figure 7A:
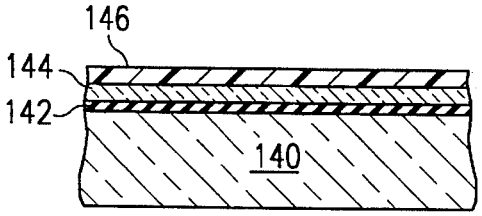
FIGS. 7A through 7H illustrate steps in a first process for fabricating the anode plate of FIG. 2B.

A method of fabricating anode plate 40' (of FIG. 2B) for use in a field emission flat panel display device in accordance with a first embodiment incorporating the principles of the present invention, comprises the following steps, considered in relation to FIGS. 7A through 7H. Referring initially to FIG. 7A, a glass substrate 140 is coated with an insulating layer 142, typically $SiO_2$, which may be sputter deposited to a thickness of approximately 50 nm. A layer 144 of a transparent, electrically conductive material, typically ITO, is deposited on layer 142, illustratively by sputtering to a thickness of approximately 150 nm. A layer 146 of photoresist, illustratively type AZ-1350J, is coated over layer 144, to a thickness of approximately 1000 nm.

Figure 7B:
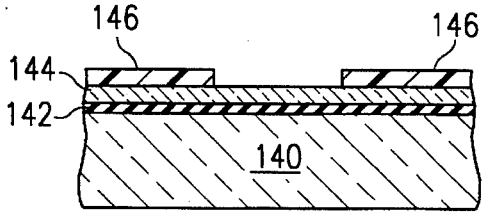
Figure 7C:
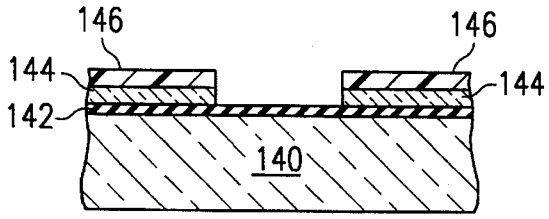
Figure 7D:
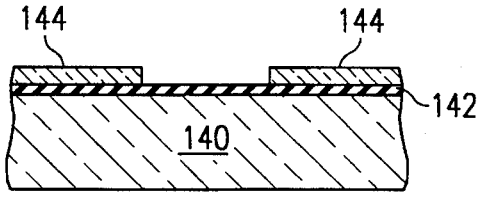

A patterned mask (not shown) is disposed over layer 146 exposing regions of the photoresist. Soaking the assembly in AZ-developer removes the unwanted photoresist, leaving photoresist layer 146 patterned as shown in FIG. 7B. The exposed regions of ITO layer 144 are then removed, typically by a wet etch process, leaving a structure as shown in FIG. 7C. Although not shown as part of this process, it may also be desired to remove $SiO_2$ layer 142 underlying the etched-away regions of the ITO layer 144. In the present example, these patterning, developing and etching processes leave regions of ITO layer 144 which form substantially parallel stripes across the surface of the anode plate. The remaining photoresist layer 146 may be removed by a wet etch process using acetone as the etchant; alternatively, layer 146 may be removed using a dry, oxygen plasma ash off process. FIG. 7D illustrates the anode structure having patterned ITO regions 144 at the current stage of the fabrication process.

A coating 148 of SOG is applied over the striped regions of layer 144 and the exposed portion of layer 142, typically to an average thickness of approximately 1000 nm above the surface of insulating layer 142. The SOG is then precured at 100° C. for about fifteen minutes to remove most of the solvent.

Figure 7E:
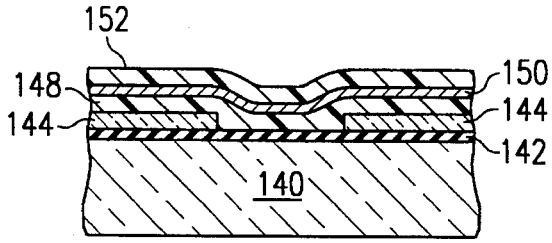

At this point, a thin-film layer 150 of a getter metal of a type discussed earlier is deposited directly on the partly cured SOG coating 148, typically to a thickness of approximately 50–100 nanometers. Getter layer 150 may be deposited, for example, by ion-beam sputtering or by e-beam evaporation. A second coating 152 of photoresist, which may be of the same type used as layer 146, is deposited over getter layer 150, typically to a thickness of 1000 nm, as illustrated in FIG. 7E.

Figure 7F:
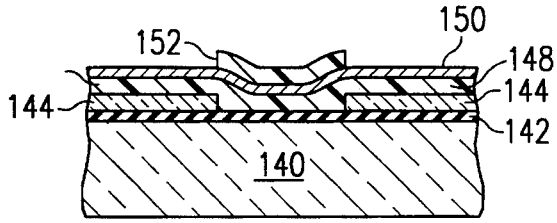
Figure 7G:
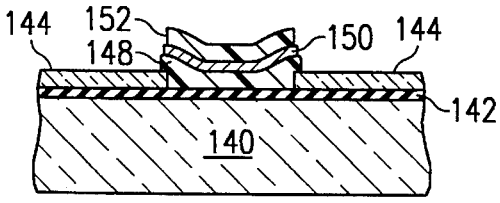

A second patterned mask (not shown) is positioned over layer 152 exposing regions of the photoresist which are to be removed during the developing step, specifically these regions lying directly over the stripes of layer 144. The photoresist is developed using AZ-developer, leaving photoresist layer 152 patterned as shown in FIG. 7F. The exposed regions of getter layer 150 and SOG layer 148 are then removed, typically by a wet etch process, leaving a structure as shown in FIG. 7G. Alternatively, the exposed regions of getter layer 150 and SOG layer 148 may be removed using an oxide (plasma) etch process.

The remaining photoresist layer 152 may be removed by a wet etch process using acetone as the etchant; alternatively, layer 152 may be removed using a dry, oxygen plasma etch process, although this process is less desirable because the oxygen plasma will oxidize the surface of the getter. The remaining SOG layer 148 is then fully cured by heating it until virtually all of the solvent and organics have been driven off, typically at a temperature of 300° C. for approximately four hours.

Figure 7H:
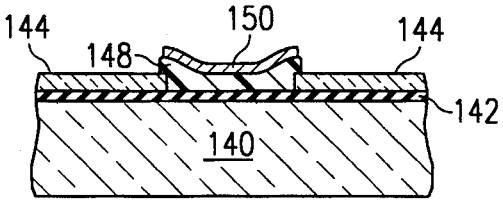

FIG. 7H illustrates the anode structure having a glass insulating region 148 between the patterned ITO stripes 144 and a layer of getter metal 150 on glass region 148 at this stage of the fabrication process. The final steps in the fabrication process of the anode structure is to provide the three thin-film phosphor coatings $44_R'$, $44_G'$ and $44_B'$ (of FIG. 2B), which are deposited over conductive ITO regions 144, typically a patterned deposition in which the phosphors are evaporated onto the anode surface.

Figure 8A:
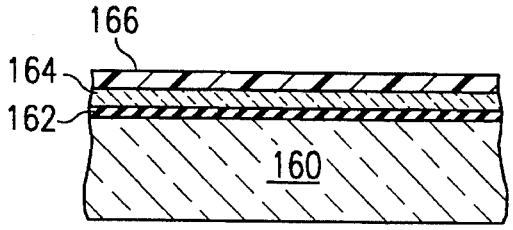
FIGS. 8A through 8E illustrate steps in a second process for fabricating the anode plate of FIG. 2B.

A method of fabricating anode plate 40' (of FIG. 2B) for use in a field emission flat panel display device in accordance with a second embodiment incorporating the principles of the present invention, comprises the following steps, considered in relation to FIGS. 8A through 8E. Referring initially to FIG. 8A, a glass substrate 160 is coated with an insulating layer 162, typically $SiO_2$, which may be sputter deposited to a thickness of approximately 50 nm. A layer 164 of a transparent, electrically conductive material, typically ITO, is deposited on layer 162, illustratively by sputtering to a thickness of approximately 150 nm. A layer 166 of photoresist, which may be type SC-100 negative photoresist, is coated over layer 164, to a thickness of approximately 1000 nm.

Figure 8B:
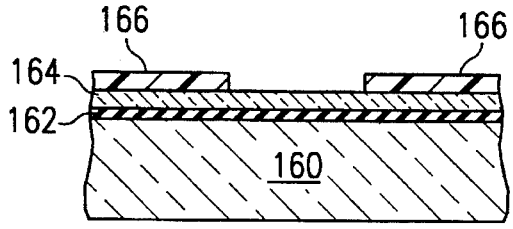
Figure 8C:
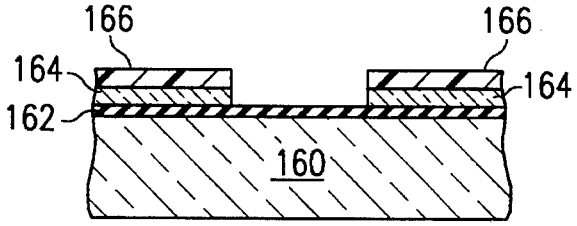

A patterned mask (not shown) is disposed over layer 166 exposing regions of the photoresist which are to remain after the developing step, which may comprise spraying the assembly first with Stoddard etch and then with butyl acetate. The unexposed regions of the photoresist are removed during the developing step, leaving photoresist layer 166 patterned as shown in FIG. 8B. The exposed regions of ITO layer 164 are then removed, typically by a wet etch process, leaving a structure as shown in FIG. 8C. In the present example, these patterning, developing and etching processes leave regions of ITO layer 164 which form substantially parallel stripes across the surface of the anode plate.

Figure 8D:
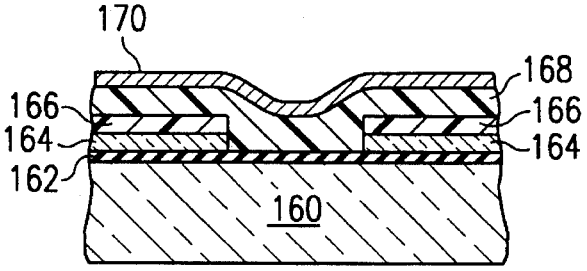

In this embodiment, the remaining photoresist layer 166 is retained, and a coating 168 of SOG is applied over the photoresist layer 164 and the exposed portion of layer 162, typically to an average thickness of approximately 1000 nm above the surface of insulating layer 162. The assembly is then heated to 100° C. for about fifteen minutes to remove most of the solvent. A thin-film layer 170 of getter metal of a type discussed earlier is deposited over the partly cured SOG layer 168, typically to a thickness of approximately 50–100 nanometers, using, for example, ion-beam sputtering or by e-beam evaporation. FIG. 8D illustrates the anode structure having patterned ITO regions 164 and photoresist regions 166, and the coatings of SOG 168 and getter metal 170 at the current stage of the fabrication process.

Figure 8E:
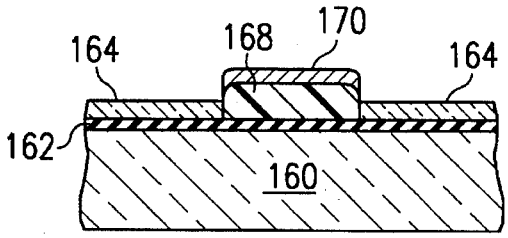

Photoresist layer 166 is then removed, bringing with it the overlaying portions of SOG layer 168 and getter metal layer 170, resulting in the structure shown in FIG. 8E. The negative photoresist 166 is removed by dipping in hot xylene and a solvent comprising perchloroethylene, tetrachloroethylene, ortho-dichlorobenzene, phenol and alkylaryl sulfonic acid, in sequence. The SOG is then fully cured by heating it until virtually all of the solvent and organics have been driven off, typically at a temperature of 300° C. for approximately four hours.

The next steps in the fabrication process of the anode structure is to provide the three thin-film coatings $44_R'$, $44_G'$ and $44_B'$ (of FIG. 2B), which are deposited over conductive ITO regions 164, typically a patterned deposition in which the phosphors are evaporated onto the anode surface. It will be seen that this process is self-aligning in that it requires only a single mask step to etch ITO stripes 164 and to form SOG insulator 168 and thin-film getter stripes 170 in the spacings between ITO stripes 164.

Several other variations in the above processes, such as would be understood by one skilled in the an to which it pertains, are considered to be within the scope of the present invention. As a first such variation, it will be understood that the insulating layer may be deposited by a technique other than those described above, for example, chemical vapor deposition. According to another variation, the SOG layer may be dry etched, illustratively in a plasma reactor. It will also be recognized that a hard mask, such as aluminum or gold, may replace the photoresist layers of the above processes. Finally, photosensitive glass materials are known, and it may be possible to pattern the SOG insulator layers directly, without the use of photoresists.

A field emission flat panel display device, as disclosed herein, including an integrated, thin-film gettering material coated on an insulator between the luminescent stripes of the anode plate, the methods disclosed for producing the thin-film getter stripes, and the methods disclosed for activating the gettering material during normal operating cycles of the display device, overcome limitations and disadvantages of the prior art display devices and methods. First, the surface area of available getter material is significantly increased over the getter area in current systems, without impacting the size or form factor of the display. Furthermore, since the available pumping surface area increases much more than linearly with the surface area due to porosity of the material, the present invention provides greatly enhanced gettering capability.

Second, the getter material of the present invention can be reactivated each time the display is turned on, or at some other selected time, such as when the battery is being charged. This is in contrast with passive getter systems where the getter material is activated only when the display is initially fabricated. Since it is known that passive getter systems saturate over time, and that display performance is improved by reactivating the getter with heat, a display including the present invention will receive the advantage of a freshly reactivated getter each time the display is started, or the battery is charged, or at some other appropriate time.

Third, the getter of the present invention is in close proximity to the phosphor, which is one of the major sources of outgassing. This proximity will greatly increase the pumping speed. The getter is also in close proximity to the microtips, which are highly sensitive to increased pressure as well as to exposure to outgassing products which can deposit on the microtips, thereby changing the work-function. This proximity will improve the local pressure environment around the tips, in contrast to the current technology where the getter is in a pump-out tube on the back of the display, far from the phosphor and the tips, and with a very poor conductance path.

Finally, the technique by which the getter material is coated onto the anode is easily accomplished using conventional processes such as lithography and lift-off. Hence, for the application to flat panel display devices envisioned herein, the approaches in accordance with the present invention provide significant advantages.

While the principles of the present invention have been demonstrated with particular regard to the structures and methods disclosed herein, it will be recognized that various departures may be undertaken in the practice of the invention. For example, the present invention is not intended to be limited to the types or thickness of gettering materials described herein. In addition, there is no requirement that the getter stripes be of uniform width, nor are they required to be on every interstice between the anode stripes. The scope of the invention is not intended to be limited to the particular structures and methods disclosed herein, but should instead be gauged by the breadth of the claims which follow.

What is claimed is:

1. A method of fabricating an anode plate for use in a field emission device, said method comprising the steps of:

providing a transparent substrate having spaced-apart, electrically conductive regions on a surface thereof;

coating said surface with a gettering material; and removing said gettering material from areas overlaying said conductive regions.

2. The method in accordance with claim 1 further including a step, prior to said step of coating said surface with a gettering material, of coating said surface with an opaque insulating material; and wherein said removing step comprises removing said gettering material and said insulating material from areas overlaying said conductive regions.

3. The method in accordance with claim 2 wherein said insulating material comprises glass.

4. The method in accordance with claim 1 wherein said gettering material is selected from the group comprising zirconium-vanadium-iron and barium.

5. The method in accordance with claim 1 wherein said providing step includes providing a substrate having spaced-apart, electrically conductive, substantially parallel stripes on said surface.

6. The method in accordance with claim 1 further including a final step of applying luminescent material on said conductive regions.

7. A method of fabricating an anode plate for use in a field emission device, said method comprising the steps of:

providing a substrate having spaced-apart, electrically conductive regions on a surface thereof; and applying gettering material on said surface in the spaces between said conductive regions.

8. The method in accordance with claim 7 wherein said providing step includes providing a substrate having spaced-apart, electrically conductive, substantially parallel stripes on said surface.

9. The method in accordance with claim 7 wherein said applying step includes applying gettering material selected from the group comprising zirconium-vanadium-iron and barium.

10. A method of fabricating a flat panel display anode plate, said method comprising the steps of:

providing a transparent substrate having a surface;

coating said surface with a transparent, electrically conductive material;

patterning regions on said coating of conductive material and removing said conductive material external of said regions;

coating said surface with an insulating material;

patterning said coating of insulating material and removing said insulating material overlying said regions;

depositing a layer of getter material on said surface;

patterning said layer of getter material and removing said getter material overlying said regions; and applying luminescent material on said conductive material on said regions.

11. The method in accordance with claim 10 wherein said step of patterning regions on said coating of conductive material and removing said conductive material external of said regions forms spaced-apart, electrically conductive, substantially parallel stripes on said surface.

12. The method in accordance with claim 10 wherein said step of coating said surface with an insulating material includes applying a layer of opaque spin-on-glass.

13. The method in accordance with claim 10 wherein said step of depositing a layer of getter material on said surface includes depositing gettering material selected from the group comprising zirconium-vanadium-iron and barium.

14. A method of fabricating a flat panel display anode plate, said method comprising the steps of:

providing a transparent substrate having a surface;

coating said surface with a transparent, electrically conductive material;

patterning regions on said coating of conductive material and removing said conductive material external of said regions;

coating said surface with an insulating material;

removing said insulating material overlying said regions;

depositing a layer of getter material on said surface;

patterning said layer of getter material and removing said getter material overlying said regions; and applying luminescent material on said conductive material on said regions.

15. The method in accordance with claim 14 wherein said step of patterning regions on said coating of conductive material and removing said conductive material external of said regions forms spaced-apart, electrically conductive, substantially parallel stripes on said surface.

16. The method in accordance with claim 14 wherein said step of coating said surface with an insulating material includes applying a layer of opaque spin-on-glass.

17. The method in accordance with claim 14 wherein said step of depositing a layer of getter material on said surface includes depositing gettering material selected from the group comprising zirconium-vanadium-iron and barium.

18. A method of fabricating a flat panel display anode plate, said method comprising the steps of:

providing a transparent substrate having a surface;

coating said surface with a transparent, electrically conductive material;

patterning regions on said coating of conductive material and removing said conductive material external of said regions;

coating said surface with an insulating material;

depositing a layer of getter material over said insulating material;

patterning said layer of getter material and removing said getter material and said insulating material overlying said regions; and applying luminescent material on said conductive material on said regions.

19. The method in accordance with claim 18 wherein said step of patterning regions on said coating of conductive material and removing said conductive material external of said regions forms spaced-apart, electrically conductive, substantially parallel stripes on said surface.

20. The method in accordance with claim 18 wherein said step of coating said surface with an insulating material includes applying a layer of opaque spin-on-glass.

21. The method in accordance with claim 18 wherein said step of depositing a layer of getter material on said surface includes depositing gettering material selected from the group comprising zirconium-vanadium-iron and barium.

* * * * *